US005711457A

United States Patent [19]

Wanbaugh et al.

[11] Patent Number: 5,711,457

[45] Date of Patent: Jan. 27, 1998

[54] TRIGGER SPRAYER FOR DISPENSING LIQUIDS COMBINED FROM SEPARATE COMPARTMENTS

[75] Inventors: Linn Wanbaugh, Lee's Summit; Phillip J. DiMaggio, Kansas City, both of Mo.

[73] Assignee: Calmar Inc., City of Industry, Calif.

[21] Appl. No.: 728,793

[22] Filed: Oct. 10, 1996

[51] Int. Cl.[6] ..... B67D 5/52

[52] U.S. Cl. ..... 222/136; 222/341; 222/383.1

[58] Field of Search ..... 222/136, 383.1, 222/341, 376, 135, 137, 145.1

[56] References Cited

U.S. PATENT DOCUMENTS

| | | | |
|---|---|---|---|
| 3,704,814 | 12/1972 | Ruscitti | 222/136 |
| 3,786,963 | 1/1974 | Metzler, III | 222/136 |
| 4,438,871 | 3/1984 | Eckert | 222/137 |
| 5,361,944 | 11/1994 | Hauf et al. | 222/136 |
| 5,385,270 | 1/1995 | Cataneo et al. | 222/136 X |
| 5,439,141 | 8/1995 | Clark et al. | 222/136 |
| 5,560,545 | 10/1996 | Grogan et al. | 222/383.1 X |
| 5,562,250 | 10/1996 | O'Niell | 222/136 X |
| 5,626,259 | 5/1997 | Maas et al. | 222/136 |

FOREIGN PATENT DOCUMENTS

| | | | |
|---|---|---|---|
| WO 93/04940 | 3/1993 | WIPO | 222/137 |

*Primary Examiner*—Kevin P. Shaver

*Attorney, Agent, or Firm*—Watson Cole Stevens Davis, P.L.L.C.

[57] ABSTRACT

A trigger actuated sprayer for dispensing disparate liquids separately stored in separate liquid compartments includes a pair of axially aligned, interconnected pistons of relatively larger and smaller diameter reciprocable in unison within relatively larger and smaller diameter cylinders for therewith defining larger and smaller variable volume pump chambers, the smaller diameter piston valving one fluid from its chamber to be combined with the other of the fluids in the other chamber during each compression stroke of the pistons. The combined liquids are dispensed from the chamber upon trigger actuation during each compression stroke.

7 Claims, 2 Drawing Sheets

45
48
44
42
54
53
43
46
41
55
52
35
51
49
47
37
29
31
32
24
36
10
39
34
33
13
23
38
14
21
28
15
19
18
16
27
17
11
25
12
26
22

TRIGGER SPRAYER FOR DISPENSING LIQUIDS COMBINED FROM SEPARATE COMPARTMENTS

BACKGROUND OF THE INVENTION

This invention relates generally to a trigger sprayer for internally combining within the pump body separately stored liquids prior to dispensing the combined liquids upon trigger actuation, and more particularly to such a trigger sprayer wherein the liquids are combined during each compression stroke during pumping.

A trigger sprayer for simultaneously dispensing different fluids separately stored in different fluid compartments, is disclosed in U.S. Pat. No. 5,535,950, commonly owned herewith. A pair of side-by-side pump pistons are simultaneously actuated for reciprocation within their respective side-by-side pump cylinders which therewith define a pair of separate variable volume pump chambers. The two fluids are combined outside the pump chambers just prior to or just after exiting the discharge orifice.

Another trigger sprayer for simultaneously dispensing different fluids separately stored in different fluid compartments, is disclosed in U.S. Pat. No. 5,560,545, commonly owned herewith. Such dispenser has a single pump piston and cylinder arrangement defining separate in-line pump chambers for pumping the disparate fluids which are combined outside the pump chambers just prior to or just after exiting the discharge orifice.

There is a need in providing a trigger sprayer capable of combining, during pumping, two separately stored formulations within the main pump chamber. Should one of the formulations be a concentrated household cleaning agent, for example, combining that formulation with a carrier solution produces a superior cleaning action compared to individual, more diluted formulations but has a limited life once combined. Efforts in the past have focused on 1:1 mixtures, although a more highly concentrated catalyst/carrier solution mixture ratio of 10:1 to 15:1 will provide the additional value for the trigger sprayer package for the consumer. Besides, early internal combining of the disparate fluids tends to reduce the cost and complexity of the sprayer package.

SUMMARY OF THE INVENTION

It is therefore an object of the present invention to provide a trigger sprayer capable of internally mixing, during pumping, a concentrate and a carrier solution stored separately, at reduced part cost and assembly yet resulting highly efficient and economical sprayer package.

Disparate liquids separately stored in separate compartments are internally combined and pumped by the manually actuated liquid pump dispenser of the invention, during each compression stroke.

The pump comprises a pair of axially aligned, interconnected pistons of relatively larger and smaller diameter reciprocable in unison within relatively larger and smaller diameter cylinders for therewith defining relatively larger and smaller diameter pump chambers. During each compression stroke, the small diameter piston valves liquid from its chamber into the chamber of the large diameter piston and cylinder so as to be combined with the other liquid therein such that the combined liquids are pumped out of the larger chamber during each compression stroke.

The small diameter piston, which is more in the nature of a valve, may be in the form of an annular conical valve sloping outwardly in a direction toward the large diameter piston, the conical valve being sufficiently resilient to deform in response to increased pressure in the small diameter chamber during each compression stroke.

Other objects, advantages and novel features of the invention will become more apparent from the following detailed description of the invention when taken in conjunction with the accompanying drawings.

DETAILED DESCRIPTION OF THE INVENTION

Figure 1:
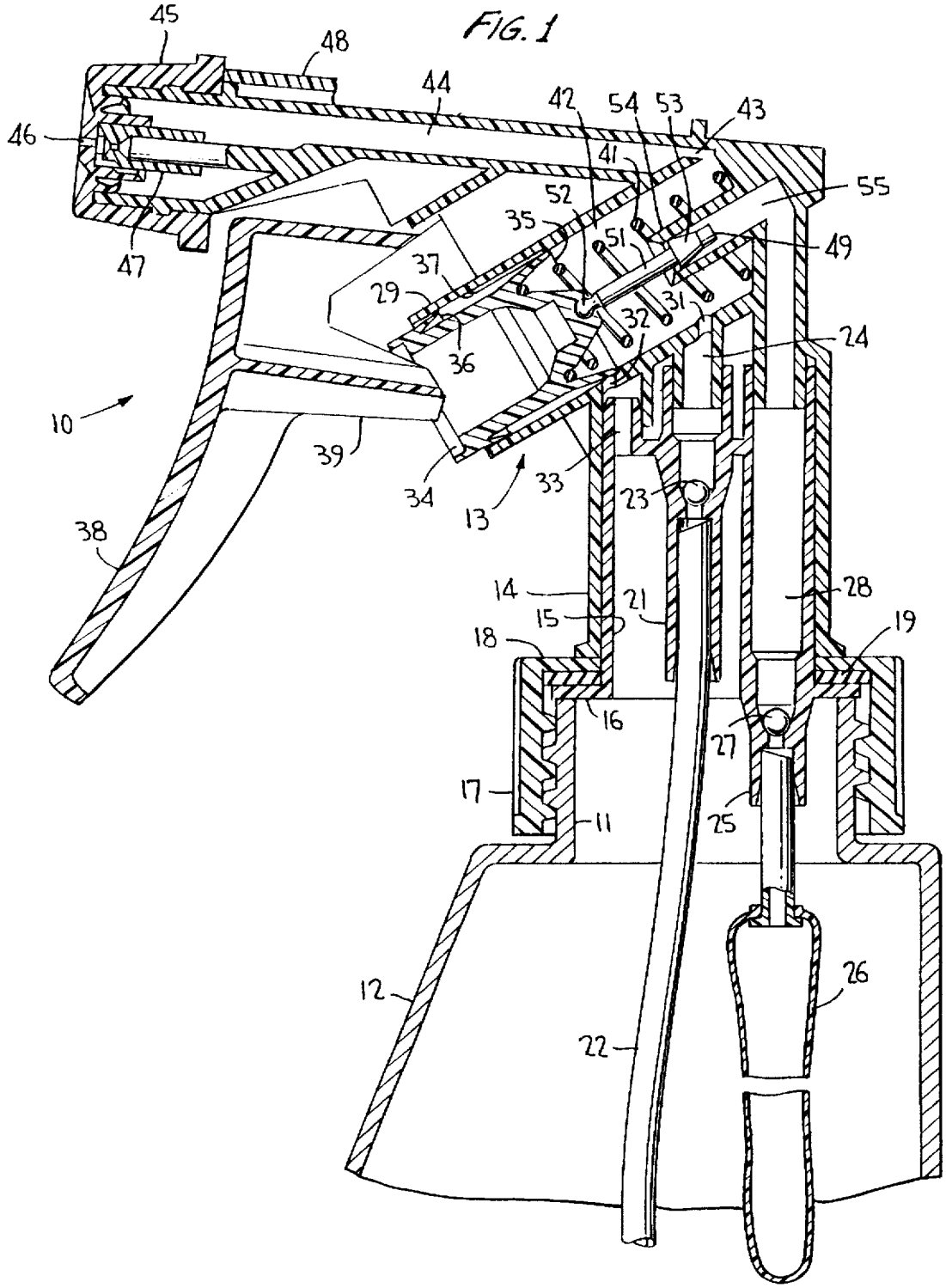
FIG. 1 is a vertical sectional view of a trigger actuated pump sprayer incorporating the invention, shown in the at rest position of the pistons.

Turning now to the drawings wherein like reference characters refer to like and corresponding parts throughout the several views, the dispenser according to the invention, generally designated 10 in the drawings, is mounted to threaded neck 11 of container 12 containing a carrier solution (not shown) which may be water. The dispenser includes a pump body 13 having an upstanding cylinder 14 into which a cylindrical neck portion 15 is frictionally fitted. The neck portion has a lower annular flange 16 overlying the upper edge of the bottle neck, a threaded closure 17 having a central opening delimited by an upper flange 18 being provided for mounting the dispenser to the container as flange 18 overlies flange 16 with an annular elastomeric seal 19 disposed therebetween. Of course, a snap closure could otherwise be provided without departing from the invention.

Neck portion 15 has a depending sleeve 21 supporting a dip tube 22 extending below the liquid level in the container in known manner. Sleeve 21 has a valve seat supporting a one-way inlet ball check valve 23 for inlet passage 24.

Neck portion 15 has another depending sleeve 25 supporting a collapsible bag 26 or the like forming a separate compartment for another liquid (not shown) which may be a formulation such as a concentrated catalyst which when mixed with the carrier solution from the container, provides a combined household cleaning formulation.

Sleeve 25 is formed with a suitable valve seat supporting an inlet ball check valve 27 of inlet passage 28.

Pump body 13 further includes a large diameter pump cylinder 29 having an inlet port 31 in communication with inlet passage 24, and having a vent port 32 communicating with the interior of container 12 via hollow nipple 33.

Figures 2, 3:
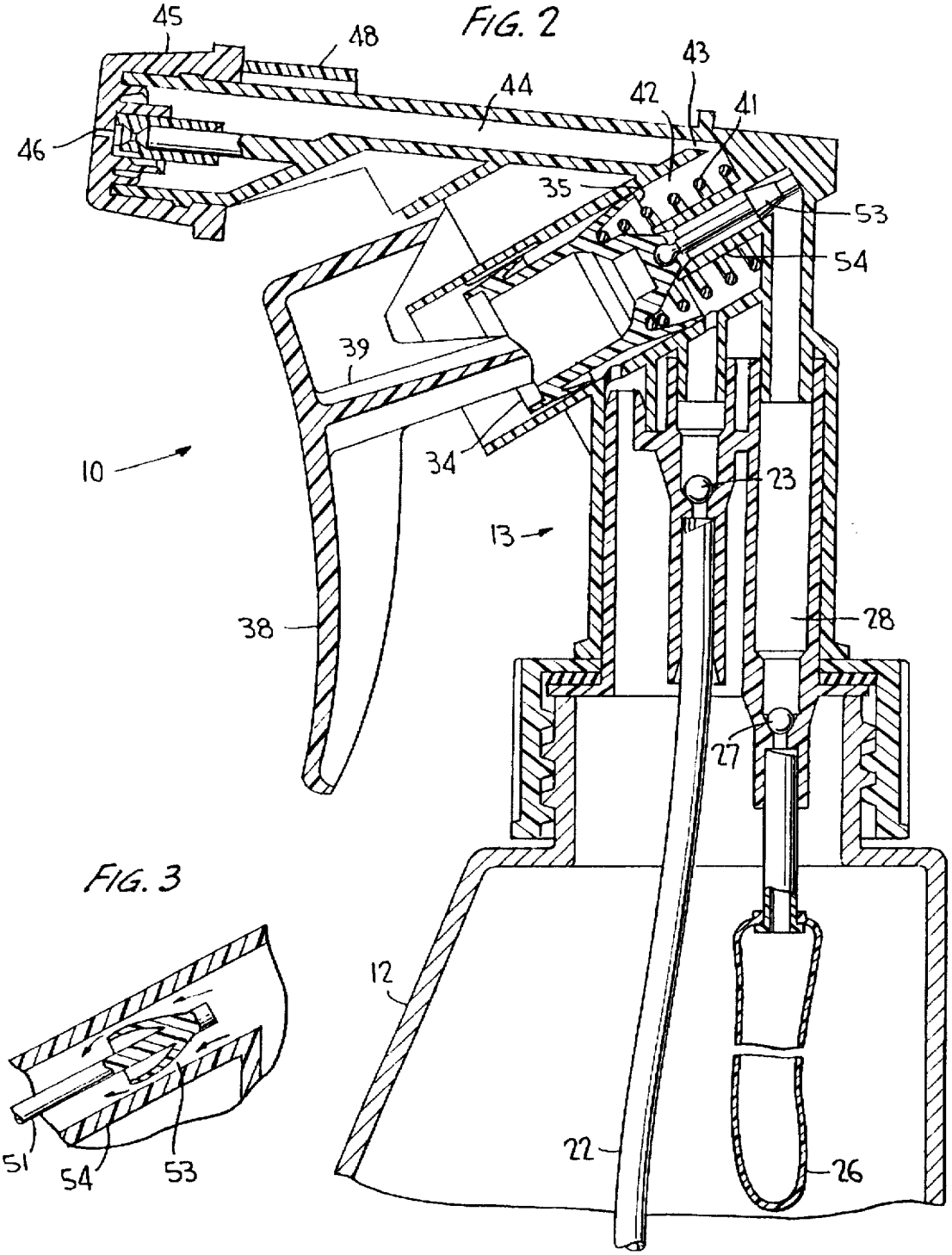
FIG. 2 is a view similar to FIG. 1 showing the pistons at the end of the compression stroke.
FIG. 3 is an enlarged sectional view showing the small diameter piston at or near the end of the compression stroke with the small diameter piston valving product out of its chamber.

A large diameter piston 34 is mounted within cylinder 29 for reciprocation between its FIG. 1 and FIG. 2 positions, the piston having an inboard annular piston seal 35 in the form of a chevron, and an outboard annular vent seal 36 likewise in the form of a chevron, both in sliding sealing engagement with the wall of cylinder 29.

The inner wall of the pump cylinder has one or more longitudinal ribs 37 (or grooves) for breaking the sealing action between vent seal 36 and the wall of the pump cylinder during piston reciprocation for establishing a vent passage from atmosphere into the container via port 32 and hollow nipple 33, as well known in this art.

A trigger actuator 38 is pivotally connected at its upper end to the body pump in some normal manner, and has a rearwardly extending tup 39 engaging the confronting outboard edge of piston 34 in the normal manner for transmitting to the piston the force applied by the operator's fingers upon pulling of the trigger against the force of a piston return spring 41 located within variable volume, large diameter pump chamber 42 defined by piston 34 and its cylinder 29.

Chamber 43 communicates with a discharge passage 44 for the combined liquids via a discharge port 43.

A rotatable nozzle cap 45 having a discharge orifice 46 is mounted at the nozzle end of the pump body and, together with a spinner probe 47 of known construction, defines spin mechanics such that the combined liquids exit the discharge orifice in the form of a fine mist spray depending on the rotated position of the nozzle cap.

A pump body shroud 48, partially shown in FIGS. 1 and 2, typically surrounds the pump body and may be in the form of the type shroud shown in either of the aforedescribed patents.

A small diameter piston 49 has a rod 51 for coupling the small diameter piston to the large diameter piston 34 as at 52. Piston 49 may be in the form of a conical valve skirt flaring outwardly in a direction toward piston seal 35, and being in the form of a chevron seal of resilient material. Piston skirt 53 slides during the reciprocation of piston 34 in sealing engagement with the wall of its cylinder 54 to therewith define a variable volume small diameter pump chamber 55 in open communication with inlet passage 28. Thus, the small and large diameter pistons are interconnected for reciprocation in unison, although their chevron seals are opposed.

Before describing the operation of the trigger sprayer according to the invention, it is assumed that pump chamber 42 is primed with liquid product from container 12, and that combined chamber 55 and passage 28 are primed with liquid from compartment 26. Thus, during each compression stroke of the pistons upon trigger actuation shown at the end of each compression stroke in FIG. 2, the product in combined chamber 55, 28, being incompressible, and being trapped therein by the seated ball check valve 27, is valved into chamber 42 as that product under pressure deforms piston skirt 53 radially inwardly creating a passage for the liquid to by-pass skirt 53 as shown by the arrows in FIG. 3. Thus, liquid product which had been suctioned into combined chamber 55, 28 during a suction stroke is valved into pump chamber 42 where it mixes with the carrier solution therein, such that the combined liquids are practically simultaneously discharged from chamber 42 via port 43 and outwardly through the discharge orifice via passage 44.

The combination of the two liquids in chamber 42 is effected during each compression stroke of the pistons while the combined liquids are likewise discharged from pump chamber 42 during those piston compression strokes.

Upon each return stroke to the FIG. 1 position, chamber 42 expands to thereby draw product from container 12 via the dip tube and unseated ball valve 23 into that chamber. Similarly, during each suction stroke product is drawn from bag 26 into chamber 55 via passage 28 and the unseated ball check valve 27.

Unwanted air from pump chamber 42 is discharged directly to atmosphere via orifice 46 during the pump priming strokes. Since the unwanted air from chamber 42 is not discharged to atmosphere through the open end of piston cylinder 29 as the same by-passes seals 35 and 36 as in the prior art, any tendency for the combined liquids to blow by from chamber 42 into the container via the vent port, is avoided. Intermingling of the combined liquids with the liquid in container 12 is therefore minimized.

It should be pointed out that piston 49 is more in the nature of a one-way valve for inletting product from chamber 55 into chamber 42 during each piston compression stroke. During each suction stroke, the piston skirt or chevron 53 of piston 49 remains in sealing engagement with the wall of its cylinder 54 thereby expanding chamber 55 which effects a suctioning of liquid product from bag 26 into the expanded chamber.

Known one-way valves other than valve chevron 53 are therefore available as equivalents to that disclosed for the small diameter piston, without departing from the invention.

Also, in lieu of dip tube 22 extending into liquid within container 12, sleeve 21 could be coupled to another collapsible bag (not shown) of carrier solution, in which case vent port 32 and vent rib 37 could also be eliminated.

The compartment formed by collapsible bag 26 could otherwise be formed by a collapsible tube or by a compartment having a known piston follower such as those provided for high viscosity products, without departing from the invention.

And, chamber 55 could be provided by, for example, the provision of a priming rib or groove on the wall of cylinder 54, such as that disclosed in U.S. Pat. No. 4,051,983, should it become necessary.

Obviously, many other modifications and variations of the present invention are made possible in the light of the above teachings. It is therefore to be understood that within the scope of the appended claims the invention may be practiced otherwise than as specifically described.

What is claimed is:

1. A manually actuated liquid pump dispenser for dispensing combined first and second fluids separately stored in respective first and second fluid compartments, comprising:

a pump body having pump means in fluid communication with said fluid compartments for simultaneously suctioning fluid therefrom and for combining the fluids prior to discharging;

said pump means comprising a pair of axially aligned, interconnected pistons of relatively larger and smaller diameter reciprocable in unison within relatively larger and smaller diameter cylinders for therewith defining first and second variable volume pump chambers;

said smaller diameter piston having means for valving one of said fluids from said second chamber to be combined with the other of said fluids in said one chamber during each compression stroke of said pistons; and actuation means on said pump body for actuating said pistons as a unit against the force of a piston return spring for dispensing said fluids as combined from said one chamber during each said compression stroke.

2. The dispenser according to claim 1, wherein said pump body has a discharge passage extending from said first chamber through which the combined fluids are discharged during each said compression stroke.

3. The dispenser according to claim 1, wherein said valving means comprises an annular conical seal on said small diameter piston outwardly sloping in a direction toward said large diameter piston.

4. A manually actuated fluid pump dispenser for combining and dispensing first and second fluids separately stored in respective first and second fluid compartments, comprising:

coaxial pump cylinders in open communication with one another receiving axially aligned, relatively large diameter and small diameter pistons to therewith define first and second variable volume pump chambers for said first and second fluids;

valve controlled first and second separate fluid inlets for said first and second fluids leading to said chambers;

means for reciprocating said pistons substantially in unison; and said small diameter piston having means for inletting the first fluid into said second chamber to be combined with the second fluid therein in response to pressure build-up in said first chamber during compression strokes of said pistons.

5. The dispenser according to claim 4, including a discharge passage leading out of said second chamber through which the combined fluids are dispensed by said large diameter piston during the compression strokes.

6. The dispenser according to claim 4, wherein said first and second fluids compartments have relative fluid capacities of about 1:10.

7. The dispenser according to claim 4, wherein a piston return spring is disposed in one of said cylinders.

* * * * *